US005888954A

United States Patent [19]

Haerer et al.

[11] Patent Number: 5,888,954

[45] Date of Patent: Mar. 30, 1999

[54] CORROSION INHIBITORS FOR SILVER

[75] Inventors: Juergen Haerer; Helmut Blum, both of Duesseldorf; Birgit Burg, Alpen; Thomas Holderbaum, Monheim; Willi Buchmeier, Mettmann; Peter Jeschke, Neuss; Horst-Dieter Speckmann, Langenfeld; Frank Wiechmann; Christian Nitsch, both of Duesseldorf, all of Germany

[73] Assignee: Henkel Kommanditgesellschaft auf Aktien, Duesseldorf, Germany

[21] Appl. No.: 919,636

[22] Filed: Aug. 28, 1997

Related U.S. Application Data

[63] Continuation of Ser. No. 545,812, filed as PCT/EP94/01386 May 2, 1994, abandoned.

[30] Foreign Application Priority Data

May 8, 1993 [DE] Germany ..... 43 15 397.6
Aug. 2, 1993 [DE] Germany ..... 43 25 922.7

[51] Int. Cl.[6] ..... C11D 3/00; C11D 3/12; C11D 3/02; C11D 3/04

[52] U.S. Cl. ..... 510/226; 510/220; 510/228; 510/229; 510/231; 510/233; 510/235; 510/236; 510/245; 510/254; 510/255; 510/258; 510/259; 510/401; 510/402; 510/367; 510/372; 510/374; 510/375; 510/376; 422/7; 422/13; 252/387; 252/389.1; 252/389.52; 252/389.54; 252/389.53; 134/25.2

[58] Field of Search ..... 510/220, 221, 510/223, 224, 226, 229, 228, 231, 233, 235, 236, 245, 254, 255, 258, 259, 401, 402, 367, 372, 374, 375, 376; 422/7, 13; 252/387, 389.1, 389.52, 389.54, 389.53; 134/25.2

[56] References Cited

U.S. PATENT DOCUMENTS

| | | | |
|---|---|---|---|
| 2,829,104 | 4/1958 | Ruff et al. | 510/401 |
| 3,494,868 | 2/1970 | Gray | 510/227 |
| 3,549,539 | 12/1970 | Mallows . | |
| 4,011,056 | 3/1977 | Steine et al. | 428/673 |
| 4,464,281 | 8/1984 | Rapisarda et al. | 510/220 |
| 4,655,953 | 4/1987 | Oakes | 510/311 |
| 4,838,125 | 6/1989 | Insalaco | 134/201 |
| 5,527,484 | 6/1996 | Ahmed et al. | 510/226 |

FOREIGN PATENT DOCUMENTS

| | | |
|---|---|---|
| 0135226 | 3/1985 | European Pat. Off. . |
| 135227 | 2/1990 | European Pat. Off. . |
| 0504091 | 9/1992 | European Pat. Off. . |
| 0541475 | 5/1993 | European Pat. Off. . |
| 4128672 | 3/1993 | Germany . |
| 1131738 | 10/1966 | United Kingdom . |

OTHER PUBLICATIONS

Roempp's Chemie Lexikon, Georg Thieme Verlag Stuttgart/New York,9th Edition, 1991, p. 3168 (month unknown).
Roempp's Chemie Lexikon, Georg Thieme Verlag Stuttgart/New York, 9th Edition, 19990, p. 2507 (month unknown).
"Korrosionskunde im Experiment" Verlag Chemie (1983), pp. 13 et. seq. (month unknown).
"Die Korrosion der Metalle", 2nd Edition, Springer Verlag (1979), pp. 117 et seq. (month unknown).
The Oxford English Dictionary, vol. XV, p. 499 (month unknown), 1989.

*Primary Examiner*—Alan Diamond
*Attorney, Agent, or Firm*—Ernest G. Szoke; Wayne C. Jaeschke; Real J. Grandmaison

[57] ABSTRACT

A process for inhibiting the corrosion of silver in a dish-washing detergent solution by adding to the solution an inorganic redox-active substance.

18 Claims, No Drawings

CORROSION INHIBITORS FOR SILVER

This application is a continuation, of application Ser. No. 08/545,812 filed on Jan. 11, 1996 now abandoned, which is a 371 of PCT/EP94/01386 filed May 2, 1994.

BACKGROUND OF THE INVENTION

1. Field of the Invention

It is a generally known fact that silver "tarnishes" even when it is not in use. It is only a matter of time before it develops dark, brownish, bluish to blue-black stains or completely discolors and, hence, is said in common usage to have "tarnished".

In practice, the machine washing of table silver also involves recurring problems in the form of tarnishing and discoloration of the silver surfaces. In this case, silver can react to sulfur-containing substances which are dissolved or dispersed in the wash liquor because, in domestic dishwashing machines (DDWM), food residues, including mustard, peas, egg, and other sulfur-containing compounds, such as mercaptoamino acid, are introduced into the wash liquor. The much higher temperatures prevailing in dishwashing machines and the longer contact times with the sulfur-containing food residues promote the tarnishing of silver by comparison with manual dishwashing. In addition, through the intensive cleaning process in dishwashing machines, the silver surface is completely degreased and, hence, becomes more sensitive to chemical influences.

Where detergents containing active chlorine are used, tarnishing by sulfur-containing compounds can largely be prevented because these compounds are reacted to sulfones or sulfates by oxidation of the sulfidic functions in a secondary reaction.

However, the problem of tarnishing in the case of silver became topical again when active oxygen compounds, such as sodium perborate or sodium percarbonate for example, were used as an alternative to active chlorine compounds to eliminate bleachable soils, for example tea stains/tea coatings, coffee residues, dyes from vegetables, lipstick residues and the like.

These active oxygen compounds are used in conjunction with bleach activators above all in modern low-alkali machine dishwashing detergents of the new generation. These modern detergents generally consist of the following functional components: builder component (complexing agent/dispersant), alkali carrier, bleaching system (bleaching agent+bleach activator), enzymes and wetting agents (surfactants).

Basically, the silver surfaces react more sensitively to the modified formulation parameters of the new-generation detergents free from active chlorine with their reduced pH values and activated oxygen bleaching. During the machine dishwashing process, these detergents release the actual bleaching agent, hydrogen peroxide or active oxygen, in the wash cycle. The bleaching effect of detergents containing active oxygen is enhanced by bleach activators so that a good bleaching effect is obtained even at low temperatures. In the presence of these bleach activators, peracetic acid is formed as a reactive intermediate compound. Under the modified washing conditions, not only are sulfidic coatings formed in the presence of silver, oxidic coatings are also formed on the silver surfaces through the oxidizing effect of the intermediately formed peroxides or the active oxygen. Chloride coatings can also be formed in the presence of high salt concentrations. In addition, tarnishing of the silver is intensified by relatively high residual water hardness values during the wash cycle.

Avoiding the corrosion of silver, i.e. the formation of sulfidic, oxidic or chloridic coatings on silver, is the subject of numerous publications. In these publications, the corrosion of silver is prevented above all by so-called silver protectives.

2. Discussion of Related Art

GB 1,131,738 describes alkaline dishwashing detergents containing benzotriazoles as corrosion inhibitors for silver. U.S. Pat. No. 3,549,539 describes highly alkaline machine dishwashing detergents which may contain inter alia perborate as oxidizing agent in conjunction with an organic bleach activator. Additions of inter alia benzotriazole and iron(III) chloride are recommended to prevent tarnishing. pH values of, preferably, 7 to 11.5 are mentioned. EP 135 226 and EP 135 227 describe low-alkali machine dishwashing detergents containing peroxy compounds and activators in which inter alia benzotriazoles and fatty acids may be present as silver protectives. Finally, it is known from DE-OS 41 28 672 that peroxy compounds activated by addition of known organic bleach activators prevent the tarnishing of silver in highly alkaline detergents.

DESCRIPTION OF THE INVENTION

It has now surprisingly been found that inorganic redox-active substances, more particularly the salts or complex compounds of certain metals not hitherto described as corrosion inhibitors for silver, effectively prevent the corrosion of silver in dishwashing machines.

The present invention relates to the use of inorganic redox-active substances as corrosion inhibitors for silver in dishwashing detergents.

The word "corrosion" is to be interpreted in its broadest chemical sense. More particularly, "corrosion" in the context of the present invention is intended to stand for any visually just discernible change in a metal surface, in the present case silver, whether for example in the form of discolored spots or, for example, in the form of stains covering a relatively large area.

"Inorganic redox-active substances" are inorganic substances which are accessible to readily occurring, reversible oxidation and/or reduction. For example, the oxides, hydroxides or halides of ammonium salts or of alkali or alkaline earth metals do not fall under this definition.

"Inorganic redox-active substances" are, for example, the substances $Na_2S_2O_3$ (sodium thiosulfate), $Na_2SO_4$ (sodium dithionite) or $N_2S_2O_5$ (sodium disulfite) which are based on various oxidation stages of sulfur.

However, the salts or complex compounds of certain metals are particularly suitable. Metal salts and/or metal complexes selected from the group consisting of manganese, titanium, zirconium, hafnium, vanadium, cobalt and cerium salts and/or complexes are preferably used to prevent the corrosion of silver, the metals being present in one of the oxidation stages II, III, IV, V or VI.

The definition commonly used in chemistry for "oxidation stage" can be found, for example, in Römpp's Chemie Lexikon, Georg Thieme Verlag Stuttgart/New York, 9th Edition, 1991, page 3168.

The metal salts or metal complexes used should be at least partly soluble in water. The counterions suitable for salt formation include any inorganic anions with one, two or three negative charges, for example oxide, sulfate, nitrate, fluoride, and also organic anions, such as stearate for example.

Metal complexes in the context of the invention are compounds which consist of a central atom and one or more ligands. The central atom is one of the metals mentioned above in one of the oxidation stages mentioned above. The ligands are neutral monodentate or polydentate molecules or anions. The term "ligand" in the context of the present invention is defined, for example, in Römpp's Chemie Lexikon, Georg Thieme verlag Stuttgart/New York, 9th Edition, 1990, page 2507. If the charge of the central atom and the charge of the ligand(s) in a metal complex do not add up to zero, either one or more of the above-mentioned anions or one or more cations, for example sodium, potassium, ammonium ions, provide for charge equalization, depending on whether an excess cationic or excess anionic charge is present. Suitable complexing agents are, for example, citrate, acetyl acetonate or 1-hydroxyethane-1,1-diphosphonate.

Particularly preferred metal salts and/or metal complexes are selected from the group consisting of $MnSO_4$, Mn(II) citrate, Mn(II) stearate, Mn(II) acetyl acetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ and mixtures thereof. $MnSO_4$ is particularly preferred.

These metal salts or metal complexes are generally commercially available substances which may be used without preliminary purification for the protection of silver against corrosion in accordance with the present invention. For example, the mixture of pentavalent and tetravalent vanadium ($V_2O_5$, $VO_2$, $V_2O_4$) known from the production of $SO_3$ (contact process) is suitable as is the titanyl sulfate ($TiOSO_4$) formed by dilution of a $Ti(SO_4)_2$ solution.

The inorganic redox-active substances, more particularly metal salts or metal complexes, are preferably coated, i.e. completely surrounded by a material which is water-resistant, but readily soluble at the dishwashing temperatures in order to prevent their premature decomposition or oxidation during storage. Preferred coating materials, which are applied by known methods, for example by the Sandwik melt coating process used in the food industry, are paraffins, microwaxes, waxes of natural origin, such as carnauba wax, candellila wax, beeswax, relatively high-melting alcohols, such as hexadecanol for example, soaps or fatty acids. The coating material, which is solid at room temperature, is applied in molten form to the material to be coated, for example by projecting fine-particle material to be coated in a continuous stream through a continuously produced spray mist zone of the molten coating material. The melting point has to be selected so that the coating material readily dissolves or rapidly melts during the subsequent use of the silver corrosion inhibitor in a dishwashing machine. For most applications, therefore, the melting point should ideally be between 45° C. and 65° C. and is preferably between 50° C. and 60° C.

However, the inorganic redox-active substances described above are particularly suitable for preventing the corrosion of silver when used in low-alkali machine dishwashing detergents. This is all the more surprising insofar as these silver corrosion inhibitors are not affected in their performance by the presence of oxygen-based bleaching agents typically present in low-alkali detergents.

Accordingly, the present invention also relates to low-alkali machine dishwashing detergents of which 1% by weight solutions have a pH value of 8 to 11.5 and preferably 9 to 10.5 and which contain 15 to 60% by weight and preferably 30 to 50% by weight of a water-soluble builder component, 5 to 25% by weight and preferably 10 to 15% by weight of an oxygen-based bleaching agent, 1 to 10% by weight and preferably 2 to 6% by weight of an organic bleach activator containing O- or N-($C_{1-12}$)-acyl groups, 0.1 to 5% by weight and preferably 0.5 to 2.5% by weight of an enzyme, based on the detergent as a whole, and silver corrosion inhibitors, an inorganic redox-active substance being present as the silver corrosion inhibitor. Metal salts and/or metal complexes selected from the group of manganese, titanium, zirconium, hafnium, vanadium, cobalt, cerium salts and/or complexes, the metals being present in one of the oxidation stages II, III, IV, V or VI, are particularly suitable.

Preferred dishwashing detergents contain metal salts or metal complexes selected from the group consisting of $MnSO_4$, Mn(II) citrate, Mn(II) stearate, Mn(II) acetyl acetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ and mixtures thereof. $MnSO_4$ is particularly preferred.

The inorganic redox-active substances, more particularly metal salts and/or metal complexes, are preferably present in the detergents according to the invention in a total quantity of 0.05 to 6% by weight and preferably 0.2 to 2.5% by weight, based on the detergent as a whole.

Organic bleach activators containing O- or N-($C_{1-12}$)-acyl groups are substances in which at least one $C_{1-12}$ acyl group, preferably the acetyl group, is attached to an O atom or an N atom present in the substance and of which the perhydrolysis gives $C_{1-12}$ alkane peracids, preferably peracetic acid.

Basically, suitable water-soluble builder components are any of the builders typically used in machine dish-washing detergents, for example polymeric alkali metal phosphates, which may be present in the form of their alkaline, neutral or acidic sodium or potassium salts. Examples include tetrasodium diphosphate, disodium dihydrogen diphosphate, pentasodium triphosphate, so-called sodium hexametaphosphate and the corresponding potassium salts or mixtures of sodium hexametaphosphate and the corresponding potassium salts or mixtures of sodium and potassium salts. The quantities of phosphate are up to about 30% by weight, based on the detergent as a whole. However, the detergents according to the invention are preferably free from such phosphates. Other possible water-soluble builder components are, for example, organic polymers of native or synthetic origin, above all polycarboxylates, which may act as cobuilders, particularly in hard water systems. For example, polyacrylic acids and copolymers of maleic anhydride and acrylic acid and also the sodium salts of these polymer acids may be used. Commercial products are, for example, Sokalan® CP 5 and PA 30 (BASF), Alcosperse® 175 or 177 (Alco), LMW® 45N and SPO2 N (Norsohaas). Native polymers include, for example, oxidized starch (for example German patent application P 42 28 786.3) and polyaminoacids, such as polyglutamic acid or polyaspartic acid, for example the products of Cygnus or SRCHEM.

Other possible builder components are naturally occurring hydroxycarboxylic acids such as, for example, monohydroxysuccinic acid, dihydroxysuccinic acid, α-hydroxypropionic acid and gluconic acid. Preferred builder components are the salts of citric acid, more particularly sodium citrate. The sodium citrate used may be anhydrous trisodium citrate and is preferably dihydrated trisodium citrate. Dihydrated trisodium citrate may be used in the form of a fine or coarse crystalline powder. Depending on the pH value ultimately established in the detergents according to the invention, the acids corresponding to citrate may also be present.

Suitable oxygen-based bleaching agents are, above all, sodium perborate monohydrate and tetrahydrate or sodium percarbonate. The use of sodium percarbonate has advantages because sodium percarbonate has a particularly favorable effect on the corrosion behavior of glasses. Accordingly, the oxygen-based bleaching agent is preferably a percarbonate salt, more particularly sodium percarbonate. Since active oxygen only develops its full effect at elevated temperatures, so-called bleach activators are used to activate it in the dishwashing machine. Suitable bleach activators are organic bleach activators containing O- or N-($C_{1-12}$)-acyl groups, for example PAG (pentaacetyl glucose), DADHT (1,5-diacetyl-2,4-dioxohexahydro-1,3,5-triazine) and ISA (isatoic anhydride), N,N,-N',N'-tetraacetyl ethylenediamine (TAED) being preferred. In addition, it can also be useful to add small quantities of known bleach stabilizers, for example phosphonates, borates or metaborates and metasilicates and also magnesium salts, such as magnesium sulfate.

To improve the removal of protein-, fat- or starch-containing food remains, the dishwashing detergents according to the invention contain enzymes, such as proteases, amylases, lipases and cellulases, for example proteases, such as BLAP® 140 (Henkel); Optimase®-M-440, Optimase®-M-330, Opticlean®-M-375, Opticlean®-M-250 (Solvay Enzymes); Maxacal® CX 450.000, Maxapem® (Ibis); Savinase® 4.0 T, 6.0 T, 8.0 T (Novo); Esperase® T (Ibis), and amylases, such as Termamyl® 60 T, 90 T (Novo); Amylase-LT® (Solvay Enzymes) or Maxamyl® P 5000, CXT 5000 or CXT 2900 (Ibis); lipases such as Lipolase® 30 T (Novo); cellulases, such as Celluzym® 0.7 T (Novo Nordisk). The dishwashing detergents preferably contain proteases and/or amylases.

In a preferred embodiment, the detergents according to the invention additionally contain the alkali carriers present in typical low-alkali machine dishwashing detergents, for example alkali metal silicates, alkali metal carbonates and/or alkali metal hydrogen carbonates. The alkali carriers normally used include carbonates, hydrogen carbonates and alkali metal silicates with a molar ratio of $SiO_2$ to $M_2O$ (M=alkali metal atom) of 1.5:1 to 2.5:1. Alkali metal silicates may be present in quantities of up to 30% by weight, based on the detergent as a whole. The highly alkaline metasilicates are preferably not used as the alkali carrier. The alkali carrier system preferably used in the detergents according to the invention is a mixture of—essentially—carbonate and hydrogen carbonate, preferably sodium carbonate and hydrogen carbonate, which is present in a quantity of up to 60% by weight and preferably 10 to 40% by weight, based on the detergent as a whole. The ratio of carbonate used to hydrogen carbonate used varies according to the pH value ultimately required or established. However, an excess of sodium hydrogen carbonate is normally used, so that the ratio by weight of hydrogen carbonate to carbonate is generally from 1:1 to 15:1.

Surfactants, more particularly low-foaming nonionic surfactants, may optionally be added to the detergents according to the invention to improve the removal of fat-containing food remains. They also serve as wetting agents, as granulation aids or as dispersion aids to improve and homogenize the distribution of the silver corrosion inhibitors in the wash liquor and on the silver surfaces. The surfactants are used in quantities of up to 5% by weight and preferably in quantities of up to 2% by weight. Extremely low-foaming compounds are normally used and preferably include $C_{12-18}$ alkyl polyethylene glycol polypropylene glycol ethers with up to 8 moles of ethylene oxide and propylene oxide units in the molecule. However, it is also possible to use other nonionic surfactants known as low foamers, including for example $C_{12-18}$ alkyl polyethylene glycol polybutylene glycol ethers containing up to 8 moles of ethylene oxide and butylene oxide units in the molecule, end-capped alkyl polyalkylene glycol mixed ethers and the foaming, but ecologically attractive $C_{8-14}$ alkyl polyglucosides with a degree of polymerization of about 1 to 4 (for example APG® 225 and APG® 600, Henkel KGaA) and/or $C_{12-14}$ alkyl polyethylene glycols containing 3 to 8 ethylene oxide units in the molecule. A bleached quality should be used because otherwise brown granules are formed. Surfactants from the family of glucamides such as, for example, alkyl-N-methyl glucamides (alkyl=$C_{6-14}$ fatty alcohol) are also suitable. In some cases, it is of advantage to use the described surfactants in the form of mixtures, for example a mixture of alkyl polyglycoside with fatty alcohol ethoxylates or a mixture of glucamides with alkyl polyglycosides, etc.

If the detergents foam excessively in use, a foam-suppressing compound, preferably from the group of silicone oils, mixtures of silicone oil and hydrophobicized silica, paraffin oil/Guerbet alcohols, paraffins, hydrophobicized silica, bis-stearic acid amides and other known commercially available defoamers, may be added to them in quantities of up to 6% by weight and preferably in quantities of about 0.5 to 4% by weight. Other optional additives are, for example, perfume oils.

The dishwashing detergents according to the invention are preferably present as powders, granules or tablets which may be produced in known manner, for example by mixing, granulation, roll compacting and/or by spray drying.

To produce detergents according to the invention in tablet form, all the constituents are preferably mixed together in a mixer and the mixture obtained is tabletted in a conventional tabletting press, for example an eccentric or rotary press, under pressures of $200.10^5$ Pa to $1500.10^5$ Pa. Breaking-resistant tablets with a flexural strength normally in excess of 150N, which still dissolve sufficiently rapidly under in-use conditions, are readily obtained in this way. A correspondingly produced tablet weighs 15 g to 40 g and, more particularly, 20 g to 30 g for a diameter of 35 mm to 40 mm.

The production of machine dishwashing detergents in the form of non-dust-emitting, storable free-flowing powders and/or granules with high apparent densities of 750 to 1000 g/l is characterized in that, in a first process step, the builder components are mixed with at least part of the liquid components with an increase in the apparent density of this premix, after which the other components of the machine dishwashing detergent, including the inorganic redox-active substances, are combined with the premix obtained, if desired after drying.

Since the possible presence of alkali metal carbonate can have a considerable effect on the alkalinity of the product, the intermediate drying step must be carried out in such a way that the decomposition of sodium bicarbonate to sodium carbonate is minimal (or at least constant). Any additional sodium carbonate formed as a result of drying would of course have to be taken into consideration in the formulation for the granules. Low drying temperatures not only counteract the decomposition of sodium bicarbonate, they also increase the solubility of the granulated detergent in use. Accordingly, drying is advantageously carried out at an inflowing air temperature which, on the one hand, should be as low as possible to avoid the decomposition of bicarbonate and which, on the other hand, must be as high as necessary to obtain a product having good storage properties. An inflowing air temperature of around 80° C. is preferable for drying. The granules themselves should not be heated to temperatures above about 60° C. In the first stage of the mixing process, the liquid components are applied to the builder generally after it has been mixed with at least one other component of the dishwashing detergent. For example, the liquid nonionic surfactants and/or the solution of perfumes may be applied to and thoroughly mixed with the builder component in the form of a mixture with perborate. The remaining components are then added and the mixture as a whole is compounded and homogenized in the mixer. There is generally no need to use additional quantities of liquid, i.e. additional water. The mixture obtained is present in the form of a free-flowing, dust-free powder with the required high apparent density of around 750 to 1000 g/l.

The granules are then mixed with the missing components of the dishwashing detergent, including inorganic redox-active substances, to form the end product. In all the cases illustrated here, the mixing time both in the preliminary stage of compacting mixing in the presence of liquid components and in the following final mixing stage where the other components are incorporated is a few minutes, for example from 1 to 5 minutes.

In one particular embodiment, it can be useful in the production of fine granules to ensure further stabilization and equalization by dusting the surface of the granules formed with powder. Small amounts of waterglass powder or powder-form alkali metal carbonate are particularly suitable for this purpose.

The detergents to be used may be used both in domestic dishwashing machines and in institutional dishwashing machines. They are added either by hand or by means of suitable dispensers. The in-use concentration in the dishwashing liquor is about 2 to 8 g/l and preferably 2 to 5 g/l.

The dishwashing program is generally extended and terminated by a few intermediate rinses with clear water after the main wash cycle and by a final wash cycle using a commercial rinse aid. Not only completely clean and hygienically satisfactory crockery but also and above all shining silverware is obtained after drying.

EXAMPLES

Silver spoons (type WMF, hotel cutlery, style Berlin) were cleaned with a silver cleaner, degreased with naphtha and dried. Three spoons were then placed in the cutlery basket of a domestic dishwashing machine (DDWM) of the Bosch S 712 type. The wash program (65° C., 16° dH) was then started and 50 g of a soil[(1)] and 30 g of the detergent were directly introduced into the machine during the main wash cycle. After rinsing and drying, the DDWM was opened for 10 minutes, then closed again and operated in the same way. After the tenth wash cycle, the spoons were removed and evaluated. Tarnishing was evaluated on a scale of 0 to 4 where 0=no tarnishing, 1=very slight yellowing, 2=stronger yellowing, 3=spoons completely gold to brown in color, 4=spoons violet to black in color; values in the upper left-hand part of Table 1.

(1) Composition of the soil:

Ketchup: 25 g

Mustard (extra sharp) 25 g

Gravy: 25 g

Potato starch: 5 g

Benzoic acid: 1 g

Egg yolk: 3 eggs

Milk: ½ l

Margarine: 92 g

Local water: 608 ml

At the same time, china was evaluated for the removal of tea stains. Evaluation was based on a scale of 0 to 10 where 0=no removal of tea stains and 10=complete removal of tea stains; values in the lower right-hand part of Table 1.

Preparation of the Tea Stain

16 Liters of cold local water (16° dH) are heated briefly to boiling point in a tank. 96 g of black tea are allowed to draw for 5 minutes in a nylon net with the cover on, after which the tea is transferred to an immersion apparatus with a heating system and stirrer. 60 Tea cups were immersed in the tea thus prepared 25 times at 1-minute intervals at a temperature of 70° C. The cups are then removed and placed on a metal plate to dry with the opening facing downwards.

Detergent Composition

The following low-alkali basic product was first prepared (a 1% by weight solution in distilled water having a pH value of 9.5):

56.0% trisodium citrate dihydrate 36.1% sodium hydrogen carbonate 6.1% sodium carbonate, anhydrous 1.8% mixture of nonionic surfactants of APG 225 ($C_{8-10}$ alkyl oligoglucoside) and Dehydol® LS2 ($C_{12-14}$ fatty alcohol 2EO ethoxylate) (1:1)

Test variations corresponding to the following formulation were then carried out with this basic product. The results are set out in Table 1.

81–86% by weight basic product

12% by weight sodium percarbonate

0–10% by weight TAED

0–2% by weight paraffin-coated manganese sulfate monohydrate

1% by weight protease

1% by weight amylase

TABLE 1

Removal of tea stains/protection of silver against corrosion

| | | | |
|---|---|---|---|
| Machine: | Bosch S 712 | Tea: | 1 = no removal |
| Dosage: | 30 g | | 10 = optional removal |
| Program: | 65° C. universal | Silver: | 0 = no tarnishing |
| Water | | | 4 = heavy tarnishing |
| hardness: | 16° H | | |

Redox-active substance $MnSO_4$
Scores: tarnishing/tea

| | | | | | | |
|---|---|---|---|---|---|---|
| 2.0% | 0 | 0 | 0 | 0 | 0 | 0 |
| | 3.0 | 3.2 | — | 3.5 | — | 3.3 |
| 1.0% | 0 | 0 | 0 | 0 | 0 | 0 |
| | 5.0 | 4.0 | 6.6 | 7.8 | — | 4.8 |
| 0.5% | 0 | 0 | 0 | 0 | 0 | 0 |
| | 7.3 | 7.8 | 8.0 | 8.5 | 8.5 | 9.8 |
| 0.4% | 0 | 0 | 0 | 0 | 0 | 0 |
| | — | 8.2 | — | 8.5 | 9.5 | 9.3 |
| 0.3% | 0 | 1 | 0 | 0 | 0 | 1 |
| | 6.1 | 9.7 | 9.2 | 8.7 | 9.0 | 8.7 |
| 0.2% | — | 1 | 1 | 1 | 1 | 2 |
| | — | 9.0 | 9.7 | 8.5 | 8.8 | 9.3 |
| 0.0% | 0 | 2 | 3 | 3 | 4 | 4 |
| | 2.2 | 5.2 | 7.0 | 7.8 | 8.2 | 9.0 |
| | 0.0% | 1.0% | 1.5% | 2.0% | 2.5% | 3.0% |
| | | | TAED | | | |

In addition, machine dishwashing detergents with the following compositions were prepared (see Table 2). Compounds A to E were used as silver corrosion inhibitors:

A: $V_2O_4/V_2O_5$

B: $TiOSO_4$

C: $CoSO_4$

D: $Ce(NO_3)_3$

E: $Na_2S_2O_3 \cdot 5H_2O$

TABLE 2

(all quantities in % by weight)

| | 1 | 2 | 3 | 4 | 5 | 6 | 7 | 8 | 9 | 10 |
|---|---|---|---|---|---|---|---|---|---|---|
| Soda | — | 27 | 8 | — | 26 | 8 | — | 26 | 8 | — |
| Na hydrogen carbonate | — | — | 31 | — | — | 30 | — | — | 30 | |
| Na disilicate | 35 | 20 | — | 35 | 20 | — | 35 | 20 | — | 34 |
| Trisodium citrate dihydrate | 40 | 25.5 | 44 | 40 | 25.5 | 44 | 39 | 25.5 | 43 | 39 |
| Polycarboxylate (Sokalan CP5 of BASF) | 10 | 10 | — | 10 | 10 | — | 10 | 10 | — | 10 |
| Na percarbonate | — | 10 | 10 | — | 10 | 10 | — | 10 | 10 | — |
| Na perborate monohydrate | 7 | — | — | 7 | — | — | 7 | — | — | 7 |
| TAED | 2 | 3 | 2 | 2 | 3 | 2 | 2 | 3 | 2 | 2 |
| $C_{12-14}$ fatty alcohol ethoxylate (2EO) (Dehydol LS2 of Henkel KGaA) | 1 | 0.75 | 1 | 1 | 0.75 | 1 | 1 | 0.75 | 1 | 1 |
| $C_{8-10}$ alkyl oligoglycoside (APG 225 of Henkel KGaA) | 1 | 0.75 | 1 | 1 | 0.75 | 1 | 1 | 0.75 | 1 | 1 |
| Protease | 1.5 | 1 | 1 | 1.5 | 1 | 1 | 1.5 | 1 | 1 | 1.5 |
| Amylase | 1.5 | 1 | 1 | 1.5 | 1 | 1 | 1.5 | 1 | 1 | 1.5 |
| Silver corrosion inhibitor A–E | (A) 1 | (B) 1 | (C) 1 | (D) 1 | (E) 2 | (A) 2 | (B) 2 | (C) 2 | (D) 3 | (E) 3 |
| pH value of a 1% aqueous solution | 10.5 | 11 | 9.5 | 10.5 | 11 | 9.5 | 10.5 | 11 | 9.5 | 10.5 |

| | 11 | 12 | 13 | 14 | 15 | 16 | 17 | 18 | 19 | 20 |
|---|---|---|---|---|---|---|---|---|---|---|
| Soda | 26 | 8 | — | 25.5 | 8 | — | 26 | 7 | — | 26 |
| Na hydrogen carbonate | — | 30 | — | — | 29 | — | — | 29 | — | — |
| Na disilicate | 19.5 | — | 34 | 19 | — | 34 | 18.5 | — | 34 | 18.5 |
| Trisodium citrate dihydrate | 25 | 43 | 38 | 25 | 43 | 38 | 24 | 43 | 38 | 24 |
| Polycarboxylate (Sokalan CP5 of BASF) | 10 | — | 10 | 10 | — | 10 | 10 | — | 9 | 10 |
| Na percarbonate | 10 | 10 | — | 10 | 10 | — | 10 | 10 | — | 10 |
| Na perborate monohydrate | — | — | 7 | — | — | 7 | — | — | 7 | — |
| TAED | 3 | 2 | 2 | 3 | 2 | 2 | 3 | 2 | 2 | 3 |
| $C_{12-14}$ fatty alcohol ethoxylate (2EO) (Dehydol LS2 of Henkel KGaA) | 0.75 | 1 | 1 | 0.75 | 1 | 1 | 0.75 | 1 | 1 | 0.75 |
| $C_{8-10}$ alkyl oligoglycoside (APG 225 of Henkel KGaA) | 0.75 | 1 | 1 | 0.75 | 1 | 1 | 0.75 | 1 | 1 | 0.75 |
| Protease | 1 | 1 | 1.5 | 1 | 1 | 1.5 | 1 | 1 | 1.5 | 1 |
| Amylase | 1 | 1 | 1.5 | 1 | 1 | 1.5 | 1 | 1 | 1.5 | 1 |
| Silver corrosion inhibitor A–E | (A) 3 | (B) 3 | (C) 4 | (D) 4 | (E) 4 | (A) 4 | (B) 5 | (C) 5 | (D) 5 | (E) 5 |
| pH value of a 1% aqueous solution | 11 | 9.5 | 10.5 | 11 | 9.5 | 10.5 | 11 | 9.5 | 10.5 | 11 |

The silver spoons were all awarded a score of 0 to 1, i.e. "very slight tarnishing, if any". In addition, compositions 1 to 20 performed excellently against bleachable stains, such as tea for example.

Although identical compositions, but without silver corrosion inhibitors A to D, also performed very well against bleachable stains, they also turned silver spoons yellow to violet in color (score: 2 to 4).

Electrochemical Measurements

Sample Preparation:

Instead of silver cutlery, silver wire (D=2 mm, 99.99%) was used as sample material for the tests. The silver wire was cut into approximately 10 cm long pieces, that part of the sample dipping into the measuring solution being rubbed with SiC abrasive paper (600 grain). The samples were then thoroughly rinsed with twice-distilled water and any abrasion residues adhering to the samples were wiped off with a fluff-free cloth. If desired, this procedure was repeated several times until the sample left a visually satisfactory impression. After rubbing with the abrasive paper, the samples were immediately used for the measurement to forestall any reaction of the metallic silver with the laboratory air. The effective surface area of the sample immersed in the solution amounted to 0.70 $cm^2$.

Electrolytes and Electrodes:

The experiments were conducted in a Duran glass cell. The above-mentioned silver wires (A=0.70 $cm^2$) were used as the measuring electrodes. The counterelectrode consisted of a gold foil (99.99%) with a surface area of 1 $cm^2$. In view of the alkaline electrolyte solutions, the reference electrode was an Hg/HgO/0.1M NaOH electrode which was connected to the electrolyte by a Haber-Luggin capillary. The measurements were carried out with 5 g/l of detergent in tap water having a hardness of 16° dH and a salt concentration of around 600 mg (dry residue).

To prepare the detergent solutions, the low-alkali basic product (see above) was first dissolved and the resulting solution was heated to 65° C. The bleaching agent and the bleach activator and/or the silver corrosion inhibitor were added immediately before the measurement. The electrochemical measurement was then carried out. During the electrochemical experiments, the electrolyte solutions were kept at 65° C. and purged with air.

Apparatus and Recording of the Measuring Curves:

To record the current/voltage curves, the electrode potential was increased at a constant rate from −0.62 V, based on a standard hydrogen electrode (SHE). After a total increase of 1.1 V, the potential was reduced at the same rate. A standard potentiostat consisting of a regenerative amplifier, differential amplifier, adder and impedance transformer and a function generator (Prodis 16 of Intelligent Controls CLZ GmbH) were used for this purpose.

Results:

The corrosion behavior was characterized on the basis of current/voltage curves. Essential information comes from the zero-axis crossing of the current/voltage curve (quiescent potential which is spontaneously established even without any external influencing of the potential) and the slope of the curve at the zero-axis crossing (reciprocal polarization resistance), E. Heitz, R. Henkhaus, A. Rahmel, "*Korrosionskunde in Experiment*" Verlag Chemie (1983), pages 13 et seq.; H. Kaesche, "*Die Korrosion der Metalle*", 2nd Edition, Springer Verlag (1979), pages 117 et seq. The addition of the silver corrosion inhibitor produces a shift in the potential of the zero-axis crossing to lower values and a reduction in the slope. Accordingly, electrochemical measurements also show that the corrosion of silver is considerably reduced by addition of the silver corrosion inhibitors.

| Composition of Detergent | Position of zero-axis crossing E (mV) (SHE) | Slope at zero axis crossing di/dE (mA/V) |
|---|---|---|
| Basic product (87%) + 12% Percarbonate + 1% TAED | 435 | 25 |
| Basic product (87%) + 12% Percarbonate + 1% Silver corrosion inhibitor*) | 360 | 0.3 |
| Basic product (86.5%) + 12% Percarbonate + 1% TAED + 0.5% Silver corrosion inhibitor*) | 405 | 7 |
| Basic product (86%) + 12% Percarbonate + 1% TAED + 1% Silver corrosion inhibitor*) | 375 | 0.6 |

*)Silver corrosion inhibitor: manganese sulfate monohydrate

We claim:

1. The process of inhibiting the corrosion of silver in a dishwashing detergent solution obtained from a detergent composition containing 15 to 60% by weight of a water-soluble builder component, 5 to 25% by weight of an oxygen-based bleaching agent, 1 to 10% by weight of an organic bleach activator containing O- or N- ($C_{1-12}$)-acyl groups, and 0.1 to 5% by weight of an enzyme, all weights being based on the weight of said detergent composition, comprising adding to said solution a silver corrosion inhibiting amount of an inorganic redox-active substance coated with a material solid at room temperature which is water-resistant but is readily soluble in water at a temperature of between 45° C. and 65° C., said inorganic redox-active substance comprising at least partly water-soluble metal salts or metal complexes selected from the group consisting of manganese, titanium, zirconium, hafnium, vanadium, cobalt and cerium salts and complexes and wherein the metals are present in one of the oxidation states II, III, IV, V or VI.

2. A process as in claim 1 wherein said metal salts or metal complexes are selected from the group consisting of $MnSO_4$, MN(II) citrate, Mn(11) stearate, MN(II) acetyl acetonate, Mn(II) {1-hydroxy-ethane-1,1-diphosphonate} $V_2O_5$, $V_2O_4$, $VO_2$, $TiOSO_4$, $K_2TIF_6$, $K_2ZrF_6$, $CoSO_4$, $Co(NO_3)_2$, and $Ce(NO_3)_3$.

3. A process as in claim 2 wherein the metal salt is $MnSO_4$.

4. A process as in claim 1 wherein said solution has a pH of from 8 to 11.5.

5. A process as in claim 1 wherein the coating material is selected from paraffins, natural waxes and alcohols having a high melting point.

6. A low-alkali machine dishwashing detergent composition wherein a 1% by weight solution thereof has a pH value of 8 to 11.5, said composition containing 15 to 60% by weight of a water-soluble builder component, 5 to 25% by weight of an oxygen-based bleaching agent, 1 to 10% by weight of an organic bleach activator containing O- or N-($C_{1-12}$)-acyl groups, 0.1 to 5% by weight of an enzyme, based on the detergent as a whole, and a silver corrosion inhibiting amount of an inorganic redox-active substance coated with a material solid at room temperature which is water-resistant but is readily soluble in water at a temperature of between 45° C. and 65° C. said inorganic redox-active substance comprising at least partly water-soluble metal salts or metal complexes selected from the group consisting of manganese, titanium, zirconium, hafnium, vanadium, cobalt, and cerium salts and complexes, and wherein the metals are present in one of the oxidation states II, III, IV, V or VI.

7. A detergent composition as in claim 6 wherein said metal salts or metal complexes are selected from the group consisting of $MnSO_4$, Mn(II) citrate, Mn(II) stearate, Mn(II) acetyl acetonate, Mn(II) {1-hydroxy-ethane-1,1-diphosphonate}, $V_2O_5$, $V_2O_4$, $VO_2$, $TiOSO_4$, $K_2TiF_6$, $K_2ZrF_6$, $CoSO_4$, $Co(NO_3)_2$, and $Ce(NO_3)_3$.

8. A detergent composition as in claim 7 wherein the metal salt is $MnSO_4$.

9. A detergent composition as in claim 6 wherein said inorganic redox-active substance is present in a quantity of 0.05 to 6% by weight based on the weight of said detergent composition.

10. A detergent composition as in claim 6 wherein said water-soluble builder component comprises a salt of citric acid.

11. A detergent composition as in claim 6 wherein said oxygen-based bleaching agent comprises a percarbonate salt.

12. A detergent composition as in claim 6 wherein said organic bleach activator containing O- or N-($C_{1-12}$)-acyl groups is N, N, N', N'-tetraacetyl ethylenediamine.

13. A detergent composition as in claim 6 wherein said enzyme is selected from the group consisting of an amylase and a protease.

14. A detergent composition as in claim 6 further containing up to 60% by weight, based on the weight of said detergent composition, of an alkali carrier system consisting essentially of carbonate and hydrogen carbonate.

15. A detergent composition as in claim 6 further containing up to 5% by weight of surfactants, based on the weight of said detergent composition.

16. A detergent composition as in claim 6 in tablet form.

17. A detergent composition as in claim 6 in the form of a powder or granules and having an apparent density of 750 g/l to 1000 g/l.

18. A detergent composition as in claim 6 wherein the coating material is selected from paraffins, natural waxes and alcohols having a high melting point.

* * * * *